US006336564B1

(12) United States Patent
Garnier

(10) Patent No.: US 6,336,564 B1
(45) **Date of Patent: *Jan. 8, 2002**

(54) DISPLAY DEVICE FOR ARTICLES SUCH AS COSMETIC PRODUCTS OR PERFUMES

(75) Inventor: Dominique Garnier, L'Isle Adam (FR)

(73) Assignee: Parfums Christian Dior, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/452,455

(22) Filed: Dec. 2, 1999

Related U.S. Application Data

(63) Continuation of application No. 08/806,374, filed on Feb. 27, 1997.

(30) Foreign Application Priority Data

Dec. 5, 1996 (FR) ..... 96 14953

(51) Int. Cl.[7] ..... A47F 5/00

(52) U.S. Cl. ..... 211/162; 211/85.26; 211/94.02

(58) Field of Search ..... 211/162, 94.01, 211/175, 59.2, 86.01, 94.02, 85.26, 169, 119.03, 108; 312/246, 349, 351.11; 248/429, 430, 424

(56) References Cited

U.S. PATENT DOCUMENTS

| | | | | | |
|---|---|---|---|---|---|
| 401,015 | A | * | 11/1889 | sussman | D32/37 |
| 794,809 | A | * | 7/1905 | Marsh | 211/162 |
| 1,486,139 | A | * | 3/1924 | Herring et al. | 211/59.2 |
| 2,098,828 | A | * | 11/1937 | Ludwick | 211/162 |
| 2,495,877 | A | * | 1/1950 | Theilman | 211/162 X |
| 2,769,551 | A | * | 11/1956 | Just | 211/162 |
| 3,685,660 | A | | 8/1972 | Saunders | 211/60.1 |
| 3,915,306 | A | * | 10/1975 | Desisto et al. | 211/4 |
| 4,030,609 | A | * | 6/1977 | Liebetrau et al. | 211/162 |
| 4,420,077 | A | * | 12/1983 | Roccaforte | 206/45.14 |
| 4,527,694 | A | * | 7/1985 | Bolt et al. | 211/162 |
| 4,606,280 | A | | 8/1986 | Poulton et al. | 108/97 |
| 4,657,317 | A | * | 4/1987 | Gemma | 312/198 |
| 4,774,780 | A | * | 10/1988 | Crowell | 40/124.1 |
| 4,805,331 | A | * | 2/1989 | Boggess et al. | 40/651 |
| 4,925,038 | A | * | 5/1990 | Gajewski | 211/59.2 |
| 4,982,852 | A | | 1/1991 | Johansen | 211/162 |
| 5,072,838 | A | * | 12/1991 | Price, Jr. et al. | 211/162 |
| 5,086,936 | A | * | 2/1992 | Remmers | 211/162 |
| 5,109,994 | A | * | 5/1992 | Kidd et al. | 211/162 |
| 5,154,305 | A | * | 10/1992 | Whitney | 211/162 |
| 5,183,162 | A | * | 2/1993 | Ritzenthaler | 211/94 |
| 5,437,379 | A | * | 8/1995 | Wolf et al. | 211/169 |
| 5,454,180 | A | * | 10/1995 | Volpe | 40/539 |
| 5,511,675 | A | * | 4/1996 | Frederick | 211/193 |
| 5,692,817 | A | * | 12/1997 | Jun et al. | 211/162 |
| 5,899,036 | A | * | 5/1999 | Seiber et al. | 52/241 |

FOREIGN PATENT DOCUMENTS

| | | |
|---|---|---|
| DE | 1 511 156 | 4/1969 |
| DE | 92 14 414.4 | 2/1993 |

* cited by examiner

*Primary Examiner*—Daniel P. Stodola
*Assistant Examiner*—Jennifer E. Novosad
(74) *Attorney, Agent, or Firm*—Pennie & Edmonds LLP

(57) ABSTRACT

A display device for articles such as cosmetic products or perfumes, which includes a plurality of display elements for articles to be tested, whereby the elements are relatively movable to uncover storage elements located immediately behind the display elements to thus provide a direct correspondence between the articles to be tested and the stored articles such as lipsticks, mascara bottles, pots for cosmetic products and various making-up goods.

16 Claims, 3 Drawing Sheets

DISPLAY DEVICE FOR ARTICLES SUCH AS COSMETIC PRODUCTS OR PERFUMES

CROSS-REFERENCE TO RELATED APPLICATIONS

This is a continuation of pending application Ser. No. 08/806,374 filed Feb. 27, 1997.

TECHNICAL FIELD

The present invention relates essentially to a display device or stand for articles such in particular as various cosmetic products or perfumes.

BACKGROUND ART

There are already found in specialized shops or stores or on sale surfaces display units for various cosmetic products such as lipsticks, mascara, nail varnishes etc . . . which may be tested by the potential buyers.

Now when the tested product suits to the purchaser, the latter, taking into account the multiplicity of the displayed products to be tested, has to do some search work in order to locate the stock of the product he desires with a view to acquire it.

The products stored for sale are indeed mostly found on a place somewhat remote from the display unit for the products to be tested or better these stored products are distributed about the periphery of the display device for products to be tested.

Therefore not only the direct correspondence between the products to be tested and the goods stored for sale is not possible or is at least difficult to be made but also the size or bulk in the shop or on the sale surface of the display unit for the products to be tested and of the storage of the products to be sold remains substantial.

The object of the present invention is therefore to remedy these problems.

SUMMARY OF THE INVENTION

For that purpose the subject of the invention is a display device for articles such as perfumes or cosmetic making-up products or others, characterized by a plurality of elements for displaying the articles to be tested, which elements are relatively movable to uncover the storage elements located immediately behind the display elements to thus provide a direct correspondence between the articles to be tested and the stored articles and to impart to the display device a compactness adapted to reduce the size or bulk of the whole of the articles to be tested and stored for sale.

According to another characterizing feature of this display device, the dimensions of the display elements for the articles to be tested are such that they permit during the relative displacement of the elements, the full view or visibility and accessibility directly of the storage elements.

The display device of this invention is further characterized in that the display elements for the articles to be tested are mounted for sliding or gliding motion on parallel and horizontal rails.

According to a preferred embodiment, each rail is fastened onto the front edge of a storage shelf or the like.

Each rail may comprise a first U-shaped portion which may be fitted in embracing relationship onto the front edge of a shelf and a second U-shaped portion in which are rolling carriages carrying the display elements for the articles to be tested.

Each aforesaid carriage according to an exemplar embodiment exhibits a W-shaped cross section provided with rollers or the like and with a support for the aforesaid display element.

According to another characterizing feature of this display device, the aforesaid support is a square or right-angle bracket both legs of which carry a panel or the like receiving the articles to be tested.

This panel preferably comprises a partly concave and partly convex arcuate front face so as to permit an easy gripping of the articles to be tested and to make the display attractive.

The invention will be better understood and further objects, characterizing features, details and advantages thereof will appear better as the following explanatory description proceeds with reference to the accompanying drawings given by way of non limiting example only and illustrating a presently preferred specific embodiment of the invention.

DETAILED DESCRIPTION OF THE PREFERRED EMBODIMENTS

Figure 1:
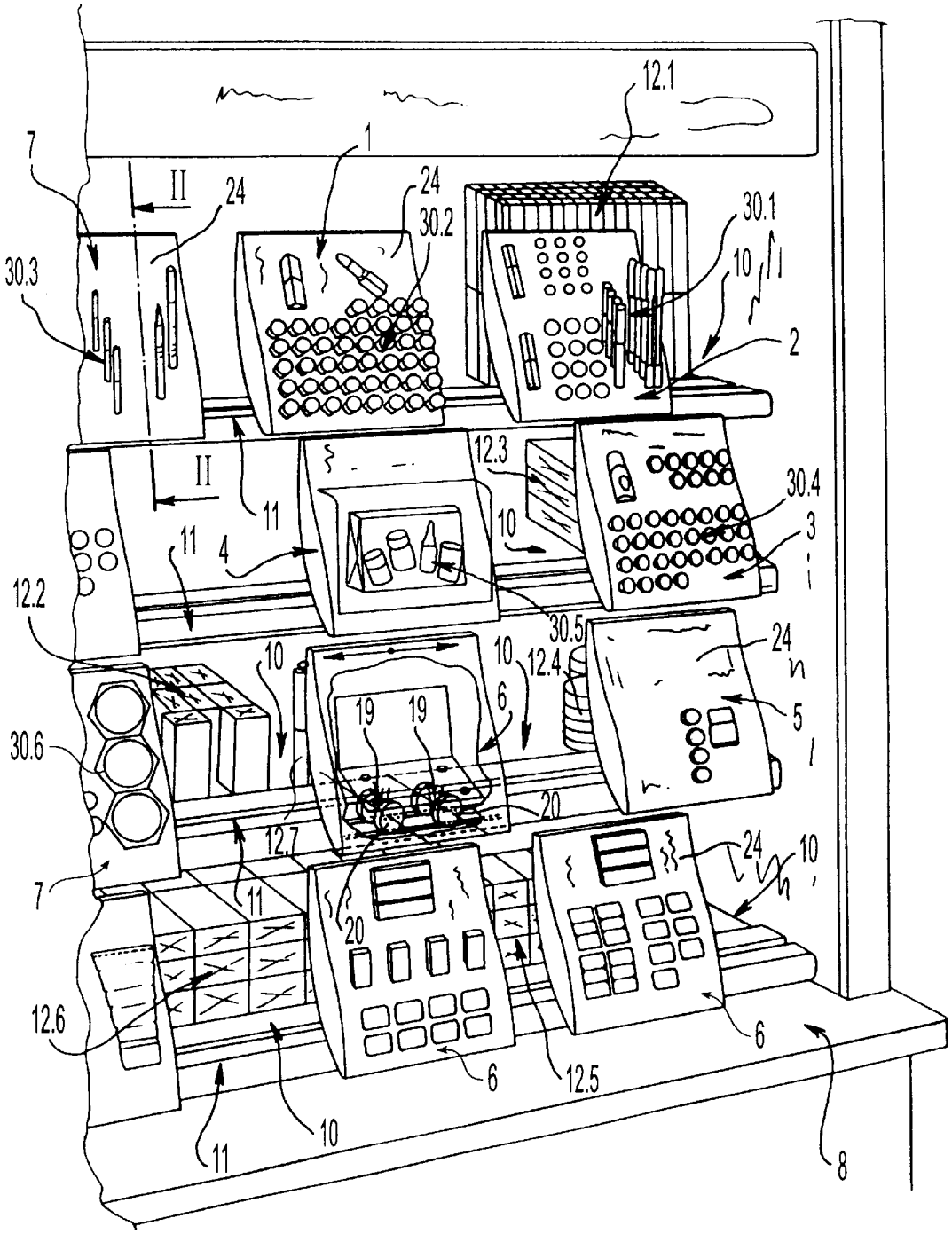
FIG. 1 is a partial perspective front view of a display device according to the invention.

Referring in particular to FIG. 1, there is seen that a display device according to this invention forms in a way a piece of furniture 8 comprising a multiplicity of display elements 1, 2, 3, 4, 5, 6, 7, . . . , n for articles to be tested, collectively referred to by reference number 30. These articles, for example, being various cosmetic products such as, for example, lipsticks 30.1 visible on the display element 1, mascara bottles 30.2 visible on the element 2, nail varnishes 30.3 visible on the element 3, pots 30.4 or the like of cosmetic products visible on element 4, etc.

Figure 2:
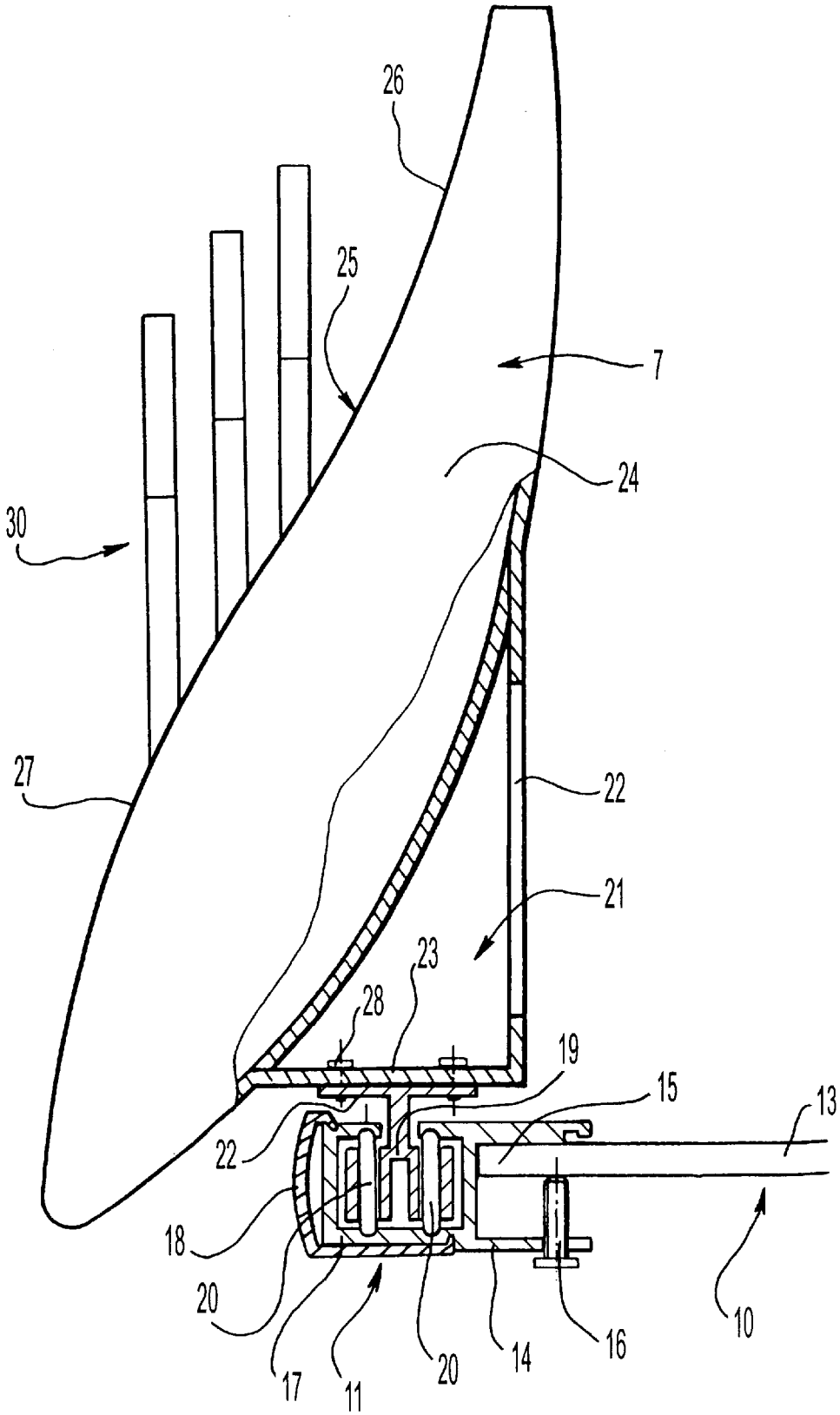
FIG. 2 is a view in section through a display element for articles to be tested, which section is taken upon the line II—II of FIG. 1.
Figure 3:
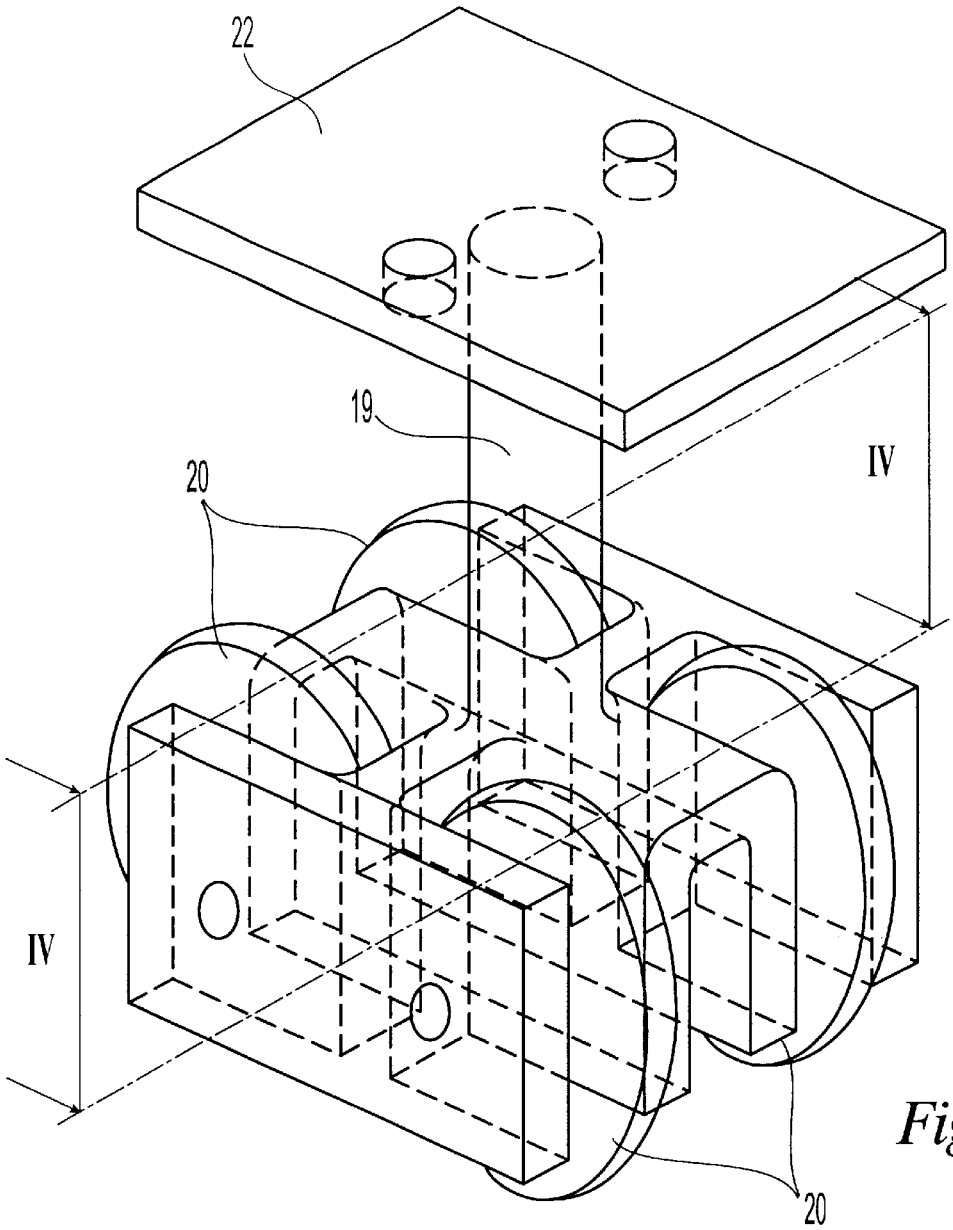
FIG. 3 is a partial perspective view of a carriage according to the invention.
Figure 4:
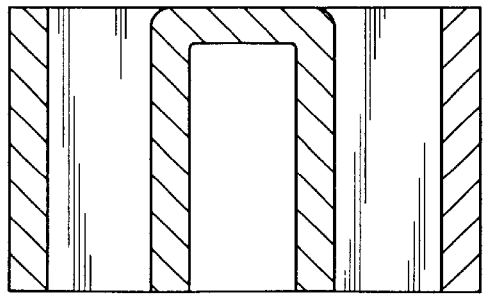
FIG. 4 is a partial cross-sectional view of a carriage according to the invention, which section taken upon the line IV—IV in FIG. 3.

All the aforesaid elements 1, 2, 3, . . . , n for displaying the goods to be tested are relatively movable for uncovering storage elements 10 which, as well seen on FIGS. 1 and 2, are located immediately behind the display elements.

Thus, as well understood, a direct correspondence may be provided between the articles to be tested 30.1, 30.2, . . . , **30.*n* on the elements 1, 2, 3, . . . , n and the articles stored for sale, collectively referred to by reference number 12, on the elements 10. Articles for sale 12 are individually referred to as 12.1 for articles positioned behind display element 1, 12.2 for articles positioned behind display element 2, . . . , and 12.n for articles positioned behind display element n. In this manner, the display device, as a whole, forming the piece of furniture 8** exhibits a remarkable compactness and therefore reduces the size or bulk of the whole of the articles to be tested and stored for sale.

The dimensions of the display elements 1, 2, 3, . . . , n for the articles to be tested 30.1, 30.2,. . . , **30.*n* may be any dimensions on condition that they be adapted during the relative displacement of the elements to permit the full direct view or visibility and accessibility of the products to be sold 12.1, 12.2, . . . , 12.*n* as stored on the storage elements 10**.

As seen on FIG. 1 and also on FIG. 2, the display elements 1, 2, 3, . . . , n for the articles to be tested 30.1, 30.2, . . . , **30.*n* are mounted for free rolling or riding on rails or the like 11. These rails 11 are parallel and horizontal, so that the display elements may be easily displaced by hand towards the left or the right of FIG. 1 in order to allow a direct access to the stored articles 12.1, 12.2, . . . , 12.*n***.

The rails 11 may be fastened in any suitable manner onto the storage elements 10 receiving the articles 12.1, 12.2, . . . , **12.*n* and located immediately behind the display elements 1, 2,3, . . . , n for the articles to be tested 30.1, 30.2, . . . , 30.*n***.

According to an exemplar embodiment, the storage elements 10 may form a shelving space consisting of a set of shelves designated at 13 on FIG. 2.

On the figures is seen that each rail 11 according to an exemplar embodiment comprises a first U-shaped portion 14 adapted to fit in embracing relationship onto the front edge 15 of one shelf 13, the fastening of the rail onto the shelf being carried out by means of a screw such as 16. With this first U-shaped portion 14 is associated a second portion 17 also U-shaped which is lined with a decorative strip 18 and which forms a rail for the rolling or riding of the display elements 1, 2, 3, . . . , n.

More specifically in the U-shaped portion 17 are rolling or riding carriages 19 supporting a display element for articles to be tested such as the element 7 visible on FIG. 2.

Each element 1, 2, 3, 4, 5, 6, 7, . . . , n comprises two carriages such as 19 as seen when referring to the display element 6 shown with parts broken away on FIG. 1.

More specifically in the U-shaped portion 17 are rolling or riding carriages 19 supporting a display element 1, 2, 3, . . . , n for articles 30.1, 30.2, . . . , **30.*n* to be tested such as the element 7 visible on FIG. 2**.

At 21 has been shown a support for the display element 1, 2, . . . , n which is made fast to the carriages 19 through the medium of a plate or the like 22.

The support 21 exhibits the general shape of a square or right-angle bracket the vertical leg 31 and the horizontal leg 23 of which carry a panel or the like 24 receiving the elements to be tested 30, the horizontal leg 23 being of course secured onto the plate 22 by means of screws 28 for example.

According to the exemplar embodiment shown on FIG. 2, each panel 24 comprises an arcuate front face 25 which in its upper part is concave as seen at 26 and which in its lower part is convex as seen at 27, thereby providing a better convenience of display and a better gripping of the articles to be tested.

There has therefore been provided according to the invention a display device of reduced size and comprising relatively movable display elements for articles to be tested permitting a direct access to the articles stored for sale immediately behind the said display elements.

The invention is of course not at all limited to the embodiment described and illustrated which has been given by way of example only.

Thus the display elements for the articles to be tested may have any shape, be in any number and carry any articles 30.1, 30.2, . . . , **30.*n* as well as the means providing the relative mobility of these elements with respect to each other may be any means on condition that they are adapted to uncover the corresponding articles 12.1, 12.2, . . . , 12.*n*** stored for sale behind the display elements.

The invention therefore comprises all the technical equivalents of the means described as well as their combinations if the latter are carried out according to its gist and within the scope of the appended claims.

What is claimed is:

1. A display device for articles comprising:

a plurality of display elements for displaying articles to be tested; and a plurality of storage elements configured and dimensioned for storing articles in the storage elements, said storage elements located immediately behind the display elements, with the plurality of display elements being relatively movable with respect to the storage elements by gliding or sliding movement on mutually parallel rails to expose at least a portion of the storage elements for access to the stored articles, wherein each of said rails is fastened onto a front edge of a corresponding storage element and wherein each of said display elements is movably mounted onto a single corresponding rail through at least first and second roller pairs spaced apart from one another in a direction perpendicular to the length of the rails, and wherein each of said roller pairs rolls onto first and second parallel rolling surfaces of said corresponding rail.

2. The display device according to claim 1, wherein each of said display elements comprises a panel for receiving articles to be tested, first and second rolling carriages aligned in a direction parallel to the corresponding rail, and a support linking the panel to the rolling carriages, each rolling carriage being provided with said first and second roller pairs.

3. A display device according to claim 1, wherein each of said rail comprises a first U-shaped portion which is fitted onto the corresponding storage element and a second U-shaped portion which includes rolling carriages that movably support the respective display element.

4. The display device according to claim 1, wherein each of said display elements are located substantially above the roller pairs.

5. A display device for articles comprising:

a plurality of display elements for displaying articles to be tested and a plurality of storage elements for storing articles for sale located immediately behind the display elements, with the plurality of display elements being relatively movable with respect to the storage elements by gliding or sliding movement on mutually parallel rails, wherein each of said rails is fastened onto a front edge of a corresponding storage element and wherein each display element is movably mounted onto a single corresponding rail through at least first and second roller pairs spaced apart from one another in a direction perpendicular to the longitudinal direction of the rails, and wherein each of said roller pairs rolls onto first and second parallel rolling surfaces of said corresponding rail;

wherein each display element comprises a panel having a front face defining a substantially arcuate side profile for receiving articles to be tested, first and second rolling carriages aligned in a direction parallel to the corresponding rail, and a support linking the panel to the rolling carriages, each rolling carriage being provided with said first and second roller pairs.

6. A display device for test products comprising:

a plurality of storage elements for storing packaged products; and a plurality of movable display elements for displaying and supporting test products which correspond to the packaged products, and are operatively coupled to the storage elements; each of the movable display elements having a front face defining a substantially arcuate side profile, wherein the storage elements are located immediately behind the display elements, so that movement of one of the display elements provides access to the storage elements.

7. A display device according to claim 6, wherein the storage elements are positioned directly behind the display elements with the display elements being configured and dimensioned such that movement of a display element permits full view and accessibility to the corresponding storage element.

8. A display device according to claim 7, wherein the display elements are mounted upon a horizontal rail for sliding movement thereupon.

9. A display device according to claim 8, wherein the rail is fastened onto a front edge of a shelf.

10. A display device according to claim 9, wherein the rail comprises a first U-shaped portion which is fitted onto the shelf and a second U-shaped portion which includes rolling carriages that movably support the respective display element.

11. A display device according to claim 10, wherein each of said carriages has a W-shaped cross-section provided with roller pairs and a support for the display element.

12. A display device according to claim 11, wherein the support comprises a right-angle bracket which carries the panel for holding the test products.

13. A display device for articles comprising:

a plurality of articles to be tested;

a plurality of display elements for displaying the articles to be tested; and a plurality of storage elements configured and dimensioned for storing additional articles for sale, said storage elements located immediately behind the display elements, with the plurality of display elements being relatively movable with respect to the storage elements by gliding or sliding movement on mutually parallel rails to expose at least a portion of the storage elements for access to the stored additional articles for sale, wherein each rail is fastened onto a front edge of a corresponding storage element and wherein each of said display elements is movably mounted onto a single corresponding rail through at least first and second roller pairs spaced apart from one another in a direction perpendicular to the length of the rails, and wherein each of said roller pairs rolls onto first and second parallel rolling surfaces of said corresponding rail.

14. A display device according to claim 13, wherein each of said rail comprises a first U-shaped portion which is fitted onto the corresponding storage element and a second U-shaped portion which includes rolling carriages that movably support the respective display element.

15. A display device for test products comprising:

a plurality of storage elements for storing a plurality of packaged products; and a plurality of test products;

a plurality of movable display elements, for displaying the test products, wherein the display elements support the test products and are operatively coupled to the storage elements, each of the movable display elements having a panel with a front face defining a substantially arcuate side profile having a portion that is at least partly concave and a portion that is at least partly convex, wherein the storage elements are located immediately behind the display elements, so that movement of one of the display elements provides access to the storage elements and a plurality of packaged products.

16. A display device for articles comprising:

a plurality of display elements for displaying a first set of articles, a plurality of storage elements positioned behind the display elements for storing a second set of articles; and a plurality of rails positioned on a front portion of the storage elements, wherein each of said display elements is independently supported by and positioned substantially above a roller carriage that is positioned for sliding movement on one of said rails.

* * * * *